United States Patent [19]

Barr

[11] Patent Number: 4,729,146

[45] Date of Patent: Mar. 8, 1988

[54] KIT FOR CLEANING PHONOGRAPH RECORDS

[76] Inventor: Jeffrey Barr, 999 Hidden Lake Dr., 8D, North Brunswick, N.J. 08902

[21] Appl. No.: 896,598

[22] Filed: Aug. 14, 1986

[51] Int. Cl.[4] ..... A47L 5/36

[52] U.S. Cl. ..... 15/303; 15/306 R; 15/354; 15/415 R; 369/72

[58] Field of Search ..... 15/303, 306 R, 310, 15/311, 308, 354, 415 R; 369/72

[56] References Cited

U.S. PATENT DOCUMENTS

| | | | |
|---|---|---|---|
| 1,296,779 | 3/1919 | Denio | 369/72 |
| 2,296,156 | 9/1942 | Fuller | 274/47 |
| 2,977,127 | 3/1961 | Mertes | 274/47 |
| 3,218,082 | 11/1965 | Taylor et al. | 274/47 |
| 4,166,626 | 9/1979 | Sandor et al. | 369/72 |
| 4,198,061 | 4/1980 | Dunn | 274/47 |
| 4,332,050 | 6/1982 | Okuda | 246/15 |
| 4,479,281 | 10/1984 | Mikutowski | 15/354 X |

FOREIGN PATENT DOCUMENTS

| | | |
|---|---|---|
| 2922397 | 12/1980 | Fed. Rep. of Germany . |
| 2087125 | 5/1982 | United Kingdom . |

OTHER PUBLICATIONS

V.P.I. Literature (1981-1982) including: -3 pages of advertizing-re: VPI Cleaning Machines -reprint Sterophile Magazine-vol. 5, No. 7, (no date) "VPI HW-16 Record Cleaning Machine"-reprint The Absolute Sound-vol. 6, No. 24, Dec. 1981 "The VPI Record Cleaning Machine"-reprint Audio, Nov. 1982, by Bert Whyte "Giving Records the Brush Off".

*Primary Examiner*—Chris K. Moore

*Attorney, Agent, or Firm*—Alan M. Sack; Richard C. Woodbridge

[57] ABSTRACT

A kit for cleaning phonograph records including cleaning fluid, a brush and a record vacuum cleaning attachment apparatus. The record vacuum cleaning attachment apparatus is adapted to attach to a wet/dry shop vacuum cleaner which causes a suction to emanate from a longitudinal slot in the lower surface of the record vacuum cleaning attachment apparatus. The suction emanating from the longitudinal slot of the record vacuum cleaning attachment apparatus safely removes the dirt, dust, grease, grime and chemicals which are suspended in the cleaning fluid applied to the playing surface of the phonograph record.

16 Claims, 14 Drawing Figures

26
34
44
30
70
62
66
28
38
36
32
29
50
40
42
41
54
58
3C
3D
W
ℓ

KIT FOR CLEANING PHONOGRAPH RECORDS

BACKGROUND OF THE INVENTION

1. Field of the Invention

This invention relates to a kit for cleaning phonograph records which includes a record vacuum cleaning attachment apparatus for attachment to a vacuum cleaner for safely removing dirt, dust, grime and chemicals suspended in cleaning fluid without damaging the playing surface of the phonograph record.

2. Description of the Related Arts

Used and neglected phonographs records are found in most homes and can be purchased by audio enthusiasts and record collectors at rummage sales, flea markets, garage sales, used record stores and at popular record conventions where thousands of old records are gathered in one place and offered for public sale.

Most old records have suffered abuse and neglect and have picked up some form of dirt, dust, grease, grime and chemical residue which should be chemically removed for enhanced audio enjoyment. In the course of operation of the inventor's business of selling collectable out of print records by mail, it has become apparent that abused records could be restored to a higher degree of fidelity and listening enjoyment by cleaning the records. The restored records bring a higher price on the market and induce customers to repeat purchases on the basis of confidence that they would get a listenable and attractive looking phonograph record.

In about 1975 an English company, Keith Monks Audio, began marketing a cleaning system for washing and cleaning phonograph records. The machine is a complicated electromechanical mechanism and includes a liquid pump, vacuum pump, power turntable and geared vacuum headarm. The machine is retailed for approximately $1,200.00. The machine is complex with many moving parts which may fail and the price is too high for many audio enthusiasts and small record collectors.

Two other companies have had some success in marketing integrated systems of pumps, vacuum pickups and turntables, but those systems are expensive. The first, the Nitty-Gritty Company offers several models of varying complexity that range in retail price from about $250.00 to $700.00. The other, the VPI Co. also offers an integrated record cleaning system that cleans and vacuums records inside a small console for approximately $350.00.

Other phonograph record vacuum cleaning devices are disclosed in U.S. Pat. Nos. 4,198,061 and 3,218,082. Also, brush type record cleaners are disclosed in U.S. Pat. Nos. 4,332,050, 2,977,127, 2,296,156, British Pat. G.B. No. 2,087,125A and German Patent DT No. 2922-397.

In particular, U.S. Pat. No. 3,218,082 issued to Taylor, et al. on Nov. 16, 1965 disclosed a "Vacuum Cleaner Attachment For Record Player" which mounts onthe side of a turntable and constantly vacuums the record while it is being played. The disadvantage of the Taylor, et al. invention is that it interferes with the playing of the record by introducing noise when the record is being played. Also, the Taylor, et al. invention must be permanenty mounted on the side of the turntable and therefore cannot be used with existing turntable platters. In addition, although capable of removing dust and loose particles the Taylor, et al. invention cannot remove grease, grime and chemicals from the playing surface of the phonograph record.

U.S. Pat. No. 4,198,061 issued to Dunn on Apr. 15, 1980 discloses an "Electrostatic-Vacuum Record Cleaning Apparatus" which imparts a static charge to dust and particles on the surface of the record to allow the dust and particles to be removed by a blower/-vacuum device. Like the Taylor invention discussed above, the Dunn invention mounts on the side of the turntable. Also, the Dunn invention uses an electrostatic charge, a blower and a vacuum but it does not use cleaning fluid. Its operation is extremely complex and although capable of electrostatically removing dust particles and some loose dirt, like the Taylor invention, it is incapable of removing grease, chemicals, and grime adhered to the playing surface of the phonograph record.

It is an object of the present invention to provide an inexpensive and relatively simple apparatus and kit which uses an inert cleaning fluid to clean the playing surface of phonograph records and a means for vacuuming the record to quickly and completely remove the dirt, dust, grease, grime and chemicals suspended in cleaning fluid and is easy to use, reliable, adjustable for all sized records and does not damage the playing surface of the phonograph records.

SUMMARY OF THE INVENTION

Briefly described, the present invention includes a kit for cleaning phonograph records which includes cleaning fluid, a brush and a record vacuum cleaning attachment apparatus. The record vacuum cleaning attachment apparatus includes a tube which is closed at one end, and an aperture for mounting the closed end onto the central spindle of a rotatable turntable. An adjustable separation means separates the tube from the surface of the phonograph record while pressing the phonograph record against the rotatable turntable. The record vacuum cleaning attachment apparatus is adapted to attach to a wet/dry shop vacuum cleaner at its other end, the vacuum causes a suction to emanate from a longitudinal slot in the lower surface of the record vacuum cleaning attachment apparatus. The suction allows the apparatus to safely remove the dirt, dust, grease, grime and chemicals which are suspended in the cleaning fluid on the playing surface of the phonograph record.

DETAILED DESCRIPTION OF THE PREFERRED EMBODIMENT

During the course this description like numbers will be used to refer to like elements according to the different figures which illustrate the invention.

Figure 1:
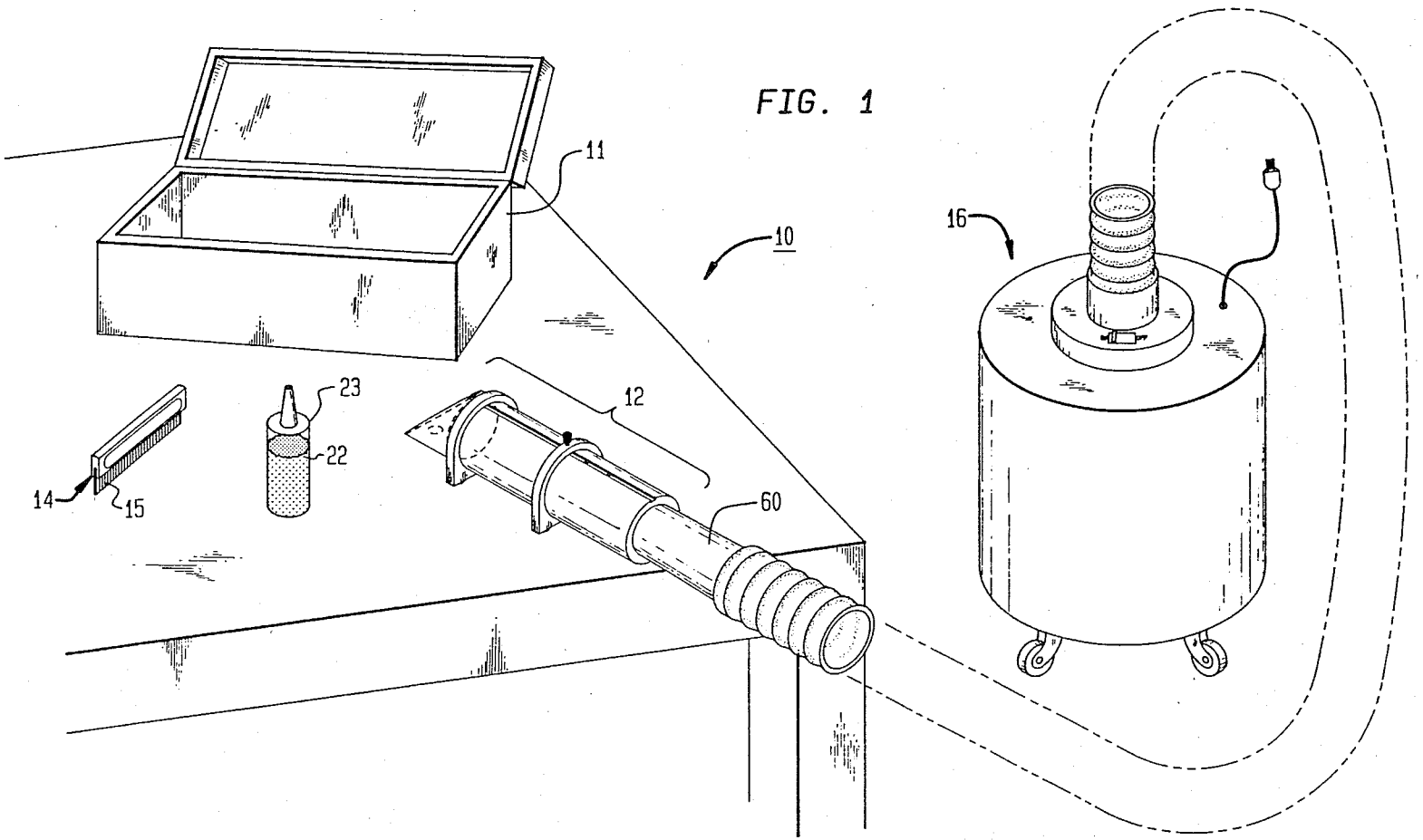
FIG. 1 is a perspective view of the preferred record vacuum cleaning attachment apparatus of the present invention attached to a wet/dry shop vacuum cleaner.
Figure 2:
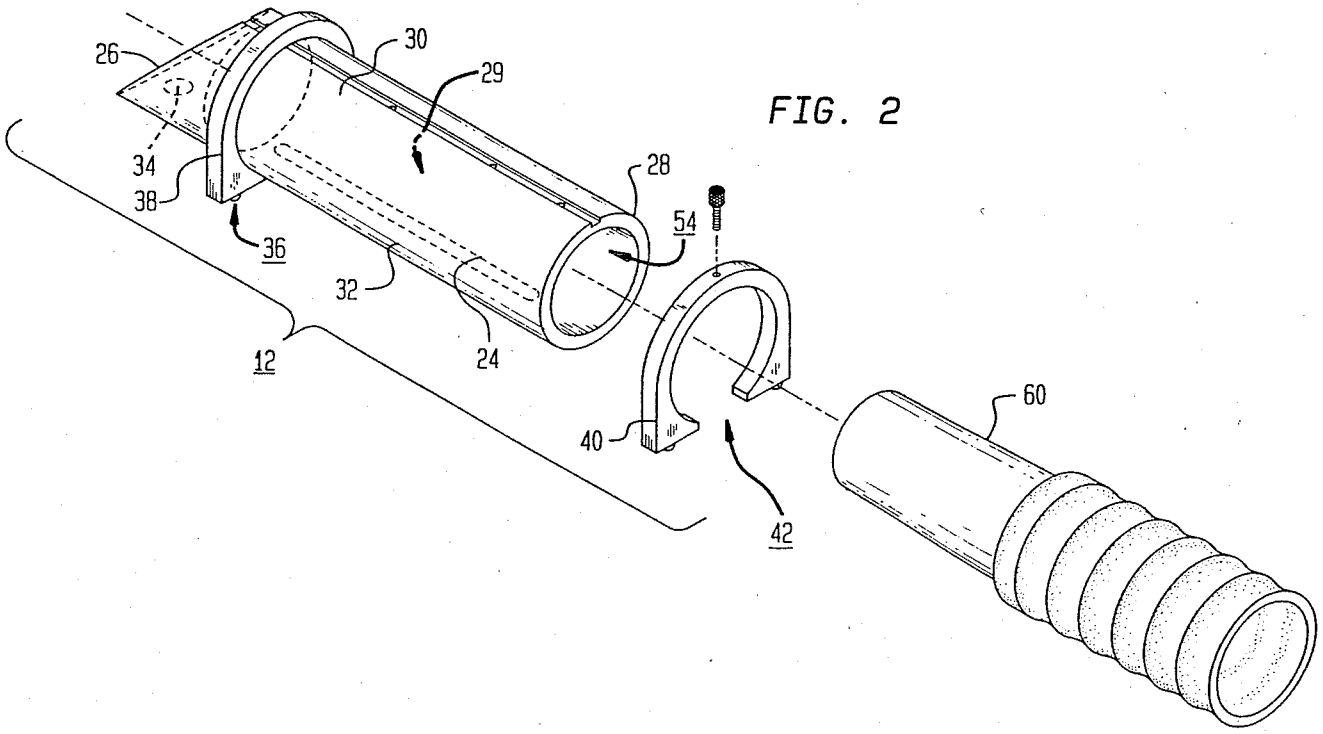
FIG. 2 is a partially exploded perspective view of the preferred record vacuum cleaning attachment apparatus of the present invention and a typical wet/dry shop vacuum cleaner nozzle.
Figures 3A, 3B, 3C, 3D, 3E:
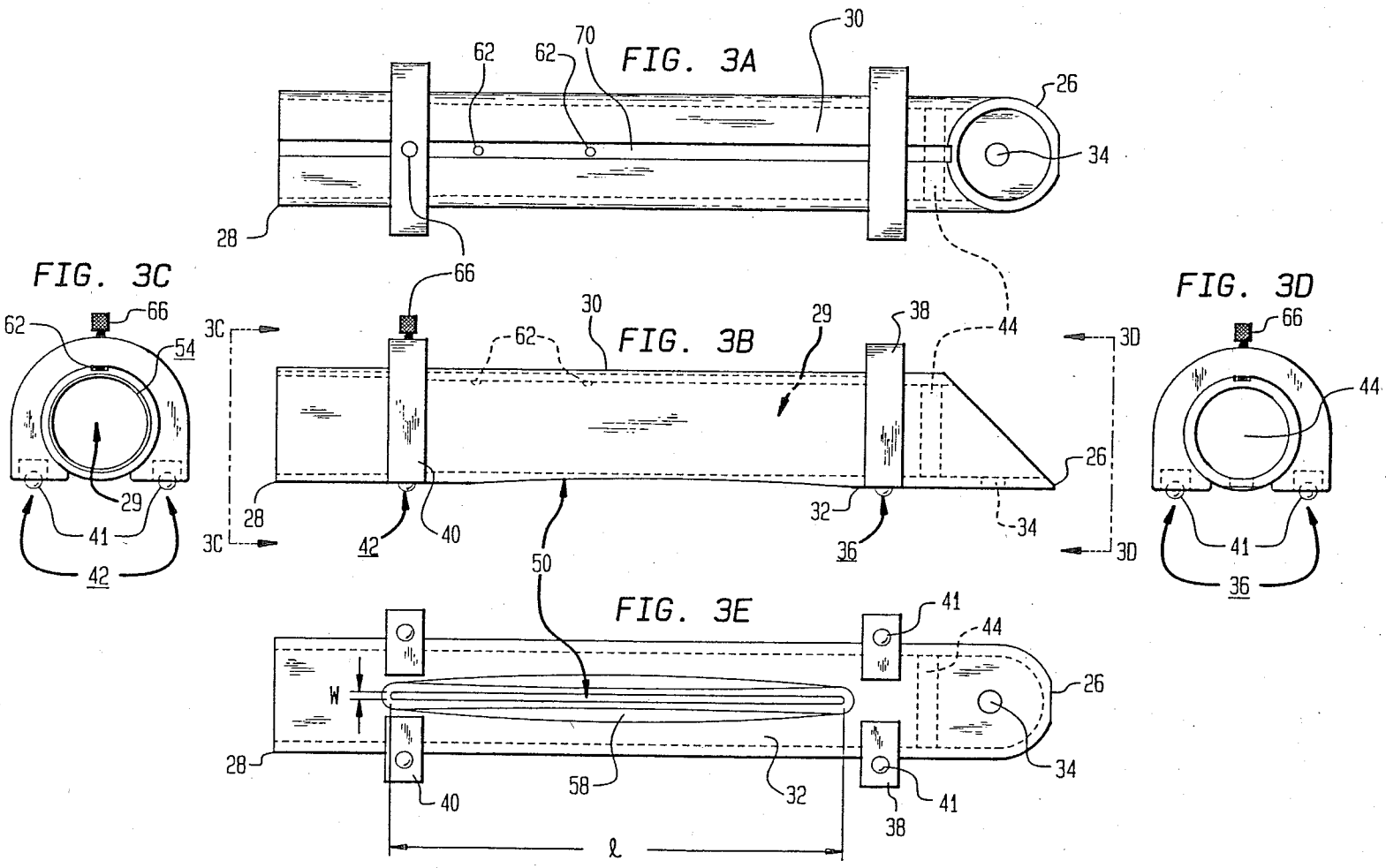
FIG. 3A is a top plan view of the preferred record vacuum cleaning attachment apparatus of the present invention.
FIG. 3B is an elevational view of the apparatus illustrated in FIG. 3A.
FIG. 3C is an elevational view of the apparatus illustrated in FIG. 3B taken in the direction of arrows 3C—3C.
FIG. 3D is an elevational cross-sectional view of the apparatus illustrated in FIG. 3B taken in the direction of arrows 3D—3D.
FIG. 3E is a bottom plan view of the apparatus illustrated in FIG. 3A.
Figure 3F:
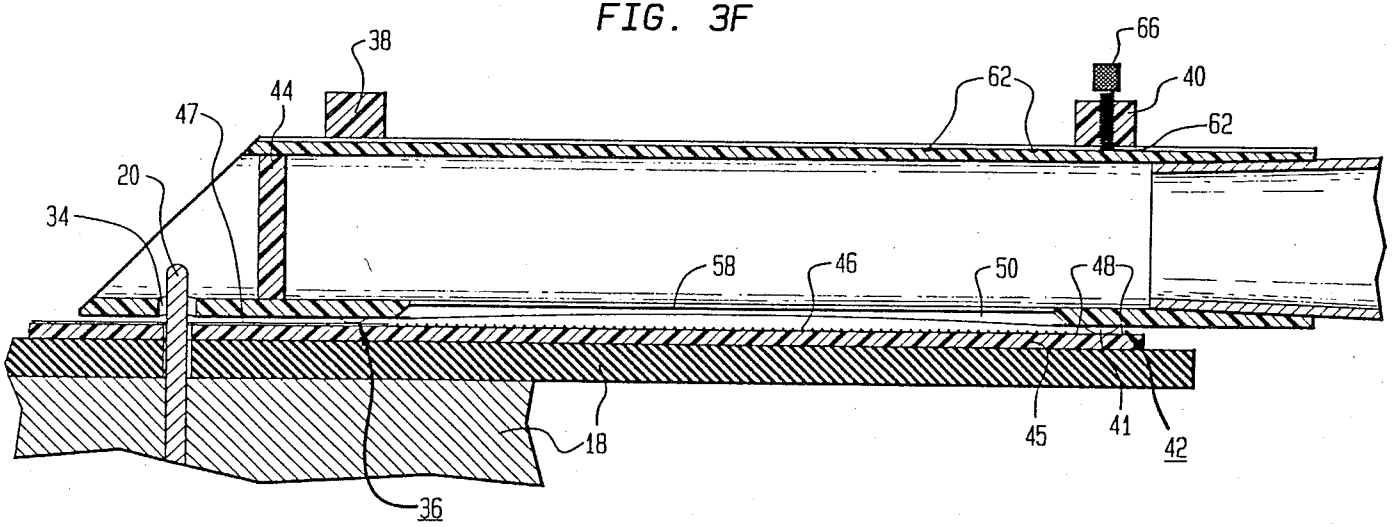
FIG. 3F is a detail cross-sectional elevational view of the apparatus illustrated in FIG. 3A mounted on a turntable platter and over a 12 inch phonograph record.

A preferred kit 10 for cleaning a phonograph record 45 according to the present invention is illustrated in FIG. 1. The preferred kit 10 may be packaged in a container 11 and includes cleaning fluid 22 in bottle 23 for loosening, dissolving and suspending dirt, dust, grime, grease and chemicals 52 on the playing surface 46 of the phonograph record 45. The preferred cleaning fluid 22 includes an aqueous solution of p-tertiary-octylphenoxy polyethyl alcohol mixed in a ratio of about 5 ml per liter of water. A concentrated solution of p-tertiary-octylphenoxy polyethyl alcohol is sold under the mark Kodak Photo-Flow 200 solution and may be diluted in a ratio of approximately 6 U.S. gallons of water for each four (4) fluid ounce (118 ml) container.

Kit 10 also includes a brush 14 for spreading the cleaning fluid 22 on the playing surface 46 of phonograph record 45 and for loosening, dissolving and suspending the dirt, dust, grease, grime and chemicals 52 on the playing surface 46 of the phonograph record 45. The brush 14 preferably is approximately 5 inches long and about a ½ inch wide with long soft bristles 15, such as the brush marketed by AKG Audio, Inc. under the mark "WATTS RECORD WASH BRUSH".

The preferred kit 10 also includes a preferred record vacuum cleaning attachment apparatus 12 which is adapted to be attached to a standard nozzle 60 of wet-dry shop vacuum cleaner 16 and is used to safely remove dirt, dust, grease, grime and chemicals 52 suspended in the cleaning fluid 22 without damaging the playing surface 46 of the phonograph record 45.

As illustrated in FIGS. 2, and FIGS. 3A through 3E, the preferred record vacuum cleaning attachment apparatus 12 includes a tube 24 which has a first end 26, a second end 28, a hollow interior 29, a top surface 30 and a bottom surface 32. Tube 24 preferably is approximately 9 inches long and has an inside diameter of about 1 and 7/32 inches, an outside diameter of about 1 and ½ inches and is made from a clear or opaque plastic material. A spindle mounting aperture 34 is included on the bottom surface 32 of the first end 26 of tube 24 for mounting the record vacuum cleaning attachment apparatus 12 onto the central spindle 20 of a rotatable turntable platter 18 for phonograph records 45, as illustrated in FIGS. 4A through 6. Spindle mounting aperture 34 has a diameter of approximately 5/16 inches and its center is located on the bottom surface 32 about 13/16 inches from the first end 26 of tube 24.

Figure 4B:
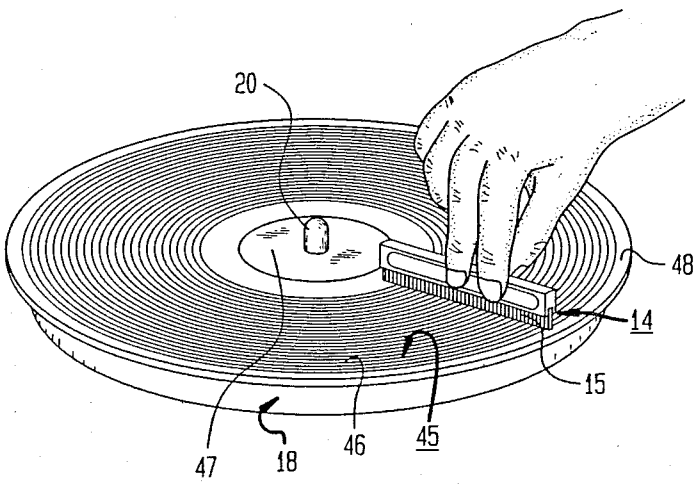
FIG. 4B illustrates the step of spreading the cleaning fluid on the upper playing surface of the 12 inch phonograph record with a brush.

The preferred record vacuum cleaning apparatus 12 also includes a means for separating tube 24 from the playing surface 46 of record 45 which includes an interior separation means 36 and an exterior separation means 42. The interior separation means 36 is attached to the bottom portion 32 of tube 24 between the spindle mounting aperture 34 and the portion of the bottom surface 32 of tube 24 which covers the playing surface 46 of phonograph record 45 when the phonograph record 45 is placed through spindle on rotatable platter 18 and the vacuum cleaning attachment apparatus 12 is mounted onto spindle 20 by means of the spindle mounting aperture 34, as illustrated in FIGS. 4C and 4D. Preferably, the interior separation means 36 is mounted about 1 and 3/8 inches from the center of spindle mounting aperture 34 toward the second end 28. The exterior separation means 42 is slidably attached to the bottom surface 2 of tube between the interior separation means 36 and the second end 28 of tube 24.

The interior separation means 36 and the exterior separation means 42 are preferably both attached to tube 24 by collars 38 and 40, respectively. Collar 38 attaches interior separation means 36 to tube 24 and is positioned near the first end of the tube and preferably fixed to the exterior of tube 24 by glue or some other means. Collar 38 preferably is attached at a point on tube 24 which covers the label 47 of phonogrpah record 45 whenever the record vacuum attachment apparatus 12 is mounted on rotatable turntable platter 18 by spindle mounting aperture 34.

Collar 40 slidably locks to hold exterior separation means 42 to tube 24 so that exterior separation means 42 on collar 40 can be slid, locked and held in position to accommodate phonograph records having different radii, such as, 7 inch 45's, 10 inch 78's and 12 inch long playing (LPs) records. The slidably locking collar 40 includes thumbscrew 66 which is threaded through the top of collar 40 and engages a slot 70 on the top surface of tube. Slot 70 has locking detents 62 that are set at about 3 and ½ inches, 5 inches, and 6 inches from the center of spindle mounting aperture in order to accommodate the popular 7 inch, 10 inch and 12 inch diameter records, respectively, so that collar 40 positions exterior separation means 42 on the outer edge 48 of the phonograph record 45 between the edge of phonograph record 45 and the outer edge of the playing surface 46. For the purpose of this application the outer edge of the playing surface is the first groove which contains information and is farthest away from label 47. As an alternative to using thumbscrew 66 a spring loaded stop means (not shown) may be utilized to engage detent 62 to allow the vacuum cleaning attachment apparatus 12 to be easily adjusted to accommodate various sized, 7 inch, 10 inch and 12 inch phonograph records 45.

The interior separation means 36 and the exterior separation means 42 on the bottoms of collars 38 and 40, respectively, include Teflon Bearings 41 mounted on the bottom of each collar 38 and 40. The Teflon Bearings 41 are preferably contained in a bearing box 43 which holds bearing 41 and which is recessed in the surface of the collars 38 and 40. As an alternative to Teflon Bearings, Teflon pads or metal or plastic rollers may be attached to the bottom surface of the collars 38 and 40, respectively. Whatever type separation means is used, however, the separation means must maintain a constant separation of about 1/32 of an inch between the bottom 32 of tube 24 and the playing surface 46 of phonograph record 45. The purpose of collars 38 and 40 is to create a base on the bottom surface 32 of tube 24 which is parallel to the playing surface 46 of the phonograph record 45. Collar 40 allows the exterior separation means 42 to be slidably adjusted so that it may rest on the outer edge 48 of various standard size records 45. If a rectangular or triangular tube 24 is used with a flat bottom surface 32, then an interior collar 38 would not be necessary since the interior separation means 36 could be attached directly to the flat bottom surface 32 of the tube 24.

Two Teflon bearings 41 are used on each collar 38 and 40, respectively, in order to maintain 5 points of contact with the surface of the record 45 to keep the playing surface 46 as flat as possible under tube 24, since the wet/dry shop vacuum cleaner 16 is actuated the suction from the apparatus 12 tends to cause record 45 to arch.

There may be many ways of making exterior separation means 40 slidably locking, and hold onto tube 24 other than the two examples discussed above. The combination of a sliding collar 40, longitudinal groove 70, locking detent 62 and thumbscrew 66 or a spring loaded stop means are only some of the variations on ways to slidably lock and holding the outer separation means 42 to the bottom surface 32 of tube 24 of the record vacuum cleaning attachment apparatus 12. Longitudinal groove 70 also serves the additional purpose of aligning the exterior separation means 42 so that the exterior separation means 42 is maintained parallel to the surface of the phonograph record 45 for all size records no matter how many times the exterior slidably locking holding collar 40 is adjusted.

The preferred record vacuum attachment apparatus 12 is attached to a standard nozzle 60 of a wet/dry shop vacuum cleaner 16 by an attachment means 54. Attachment means 54 includes a tapered entrance 56 on the interior 29 of the second end 28 of tube 24. The preferred interior dimensions of the tapered entrance 54 is approximately 1 and ¼ inches at the opening of the tapered entrance 58 at the second end 28 of the tube 24, the entrance 58 tapers to an interior dimension of approximately 1 and 7/32 inches at about 1 inch from the opening of the tapered entrance 58 in the direction towards first end 26 of tube 24. This tapered entrance accommodates a standard size nozzle 60 of most wet/dry shop vacuum cleaners 16 now in production, however, it is contemplated that a greater taper may be included in entrance 58 to accommodate a greater variety of nozzles 60.

The bottom surface 32 of tube 24 includes an opening, preferably a longitudinal slot 50 which extends approximately parallel to the longitudinally axis of tube 24 and extends over the playing surface 46 of the phonograph record when the phonograph record is placed onto the spindle 20 of rotatable turntable platter 18 and the vacuum cleaning attaching apparatus 12 is mounted onto the platter 18 by the spindle mounting aperture 34. Preferably, the bottom surface 32 of the tube is beveled along the length of the opening of slot 50 towards the interior 29 of tube 24 in a smooth arc 58. The bevel of arc 58 preferably has a radius of curvature of approximately 36 inches, the center of the beveled arc and the center of the slot 50 is approximately 3 and 15/16 inches from the center of the spindle mounting aperture 34, and slot 40 has the length of approximately 3 and ⅞ inches. Preferably, the width W of longitudinal slot 50 is about ⅛ of an inch, as measured on the interior 29 surface of tube 24, Slot 50 tapers outward towards the lower outer surface 32 of tube 24 so the walls of slot 50 are angled approximately 90 degrees apart. Tube 24 is closed by a closure means which includes a small disk 44 on the interior 29 of tube 24 for closing the first end 26 of the tube 24 at a point between the interior edge of slot 50 and the spindle mounting aperture 34.

The major steps for use of the preferred kit 10 of the present invention are illustrated in FIGS. 3F and 4A through 6.

First, the phonogrpah record 45 is placed over the central spindle 20 of the rotatable turntable platter 18.

Figure 4A:
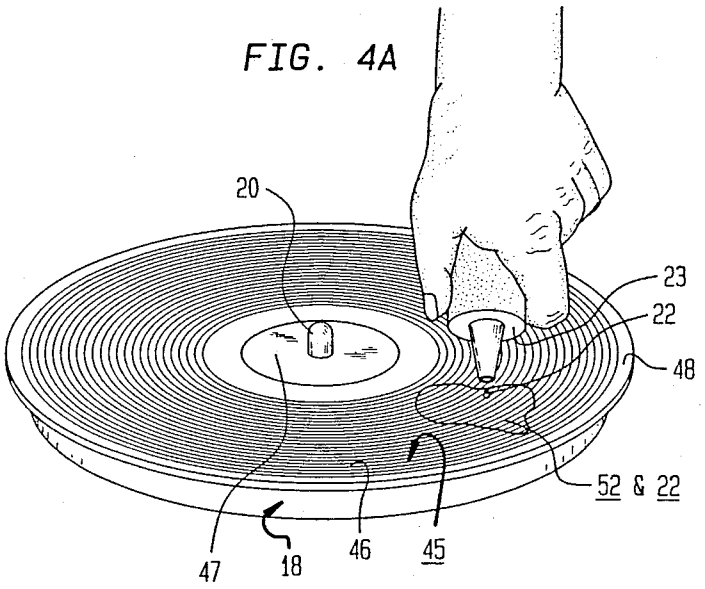
FIG. 4A illustrates the step of applying cleaning fluid to the upper playing surface of a 12 inch phonograph record which has been placed on a turntable platter.
Figure 4C:
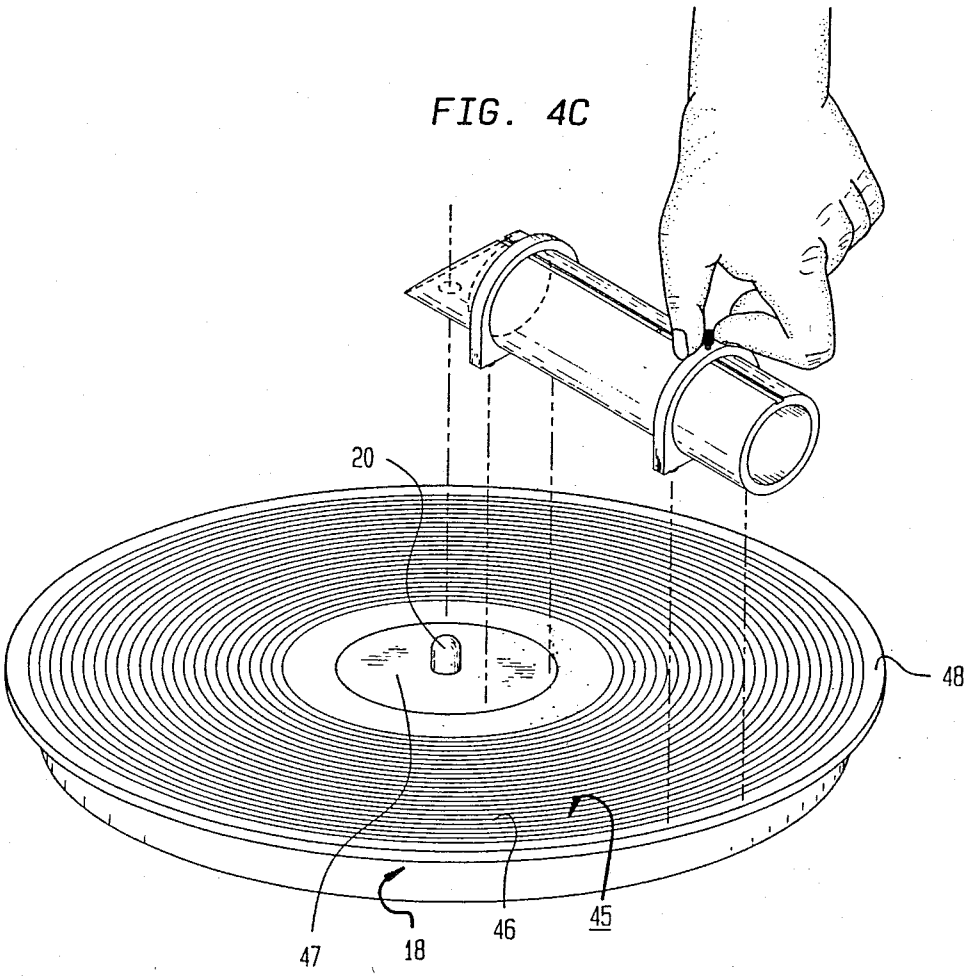
FIG. 4C illustrates the step of adjusting the sliding collar of the preferred record vacuum cleaning attachment apparatus to fit the 12 inch phonograph record illustrated in FIG. 4A.
Figure 4D:
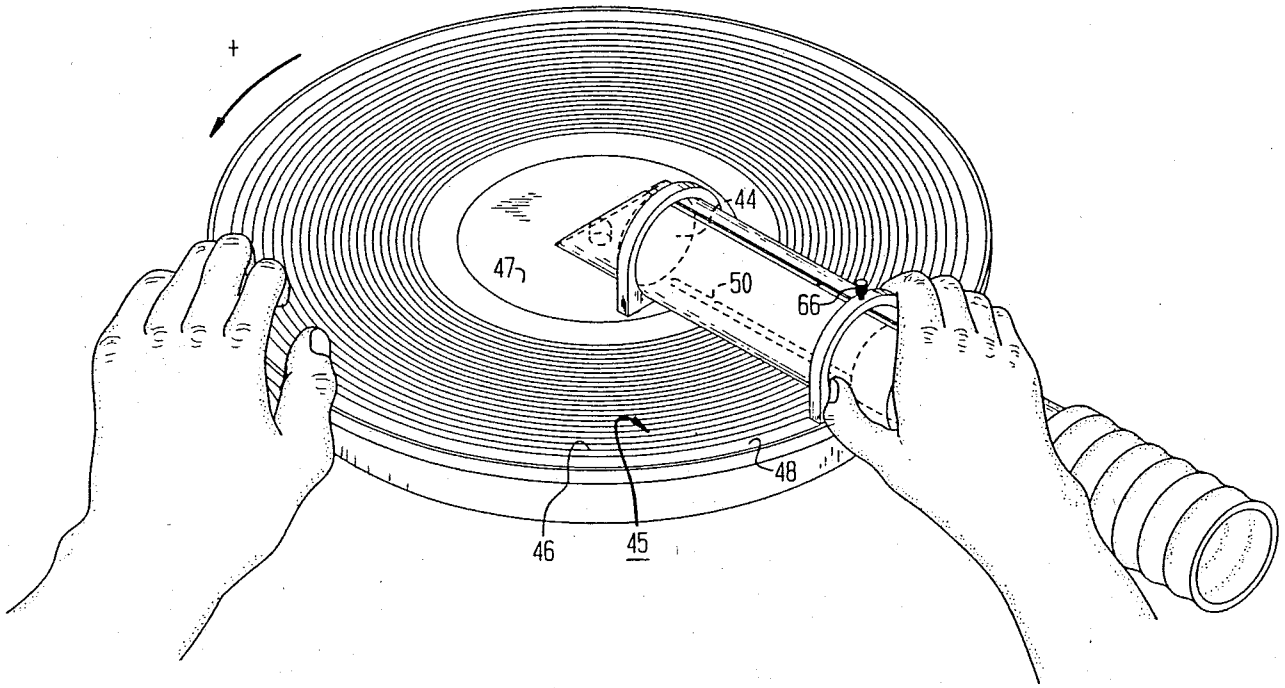
FIG. 4D illustrates the step of rotating the turntable platter and the phonograph record illustrated in FIG. 4C in relation to the preferred record vacuum cleaning attachment apparatus to remove the dirt, dust, grease, grime and chemicals which are suspended in the cleaning fluid.

Second, as illustrated in FIG. 4A, cleaning fluid 22 from bottle 23 is applied to the playing surface 46 of the phonograph record 45.

Third, as illustrated in FIG. 4B, the cleaning fluid 22 is spread over the playing surface 46 of phonograph record 45 with a brush 14 to loosen, dissolve and suspend in the cleaning fluid 22 any dirt, dust, grease, grime and chemicals 52 on the playing surface of the phonograph record 45.

Figure 6:
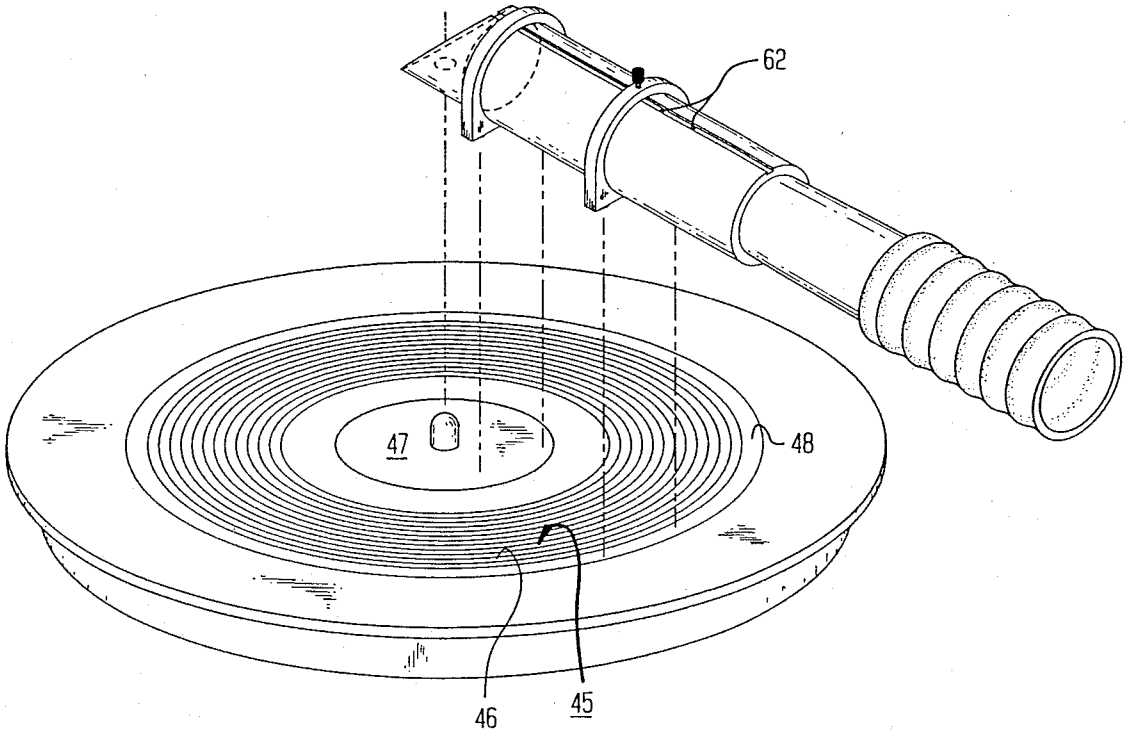
FIG. 6 shows the step of mounting the preferred record vacuum cleaning attachment apparatus attached to the nozzle of a wet/dry shop vacuum cleaner onto the central spindle of a phonograph platter and over a 7 inch phonograph record.

Fourth, as illustrated in FIGS. 4C and 6, the record vacuum cleaning attachment apparatus 12 is adjusted to accommodate the particular size phonograph record (7 inch, 10 inch or 12 inch) by slidably adjusting the collar 40 of the exterior separation means 42. Collar 40 is adjusted by loosening thumbscrew 66 and sliding the collar 40 so it is positioned over the appropriate locking detent 62 for the particular size phonograph record 45 in order for Teflon bearings 41 of exterior separation means 42 to be positioned over the outer edge 48 of phonograph record 45 when the record vacuum cleaning attachment means 12 is mounted onto the spindle 20 of the rotatable turntable platter 18.

Figure 5:
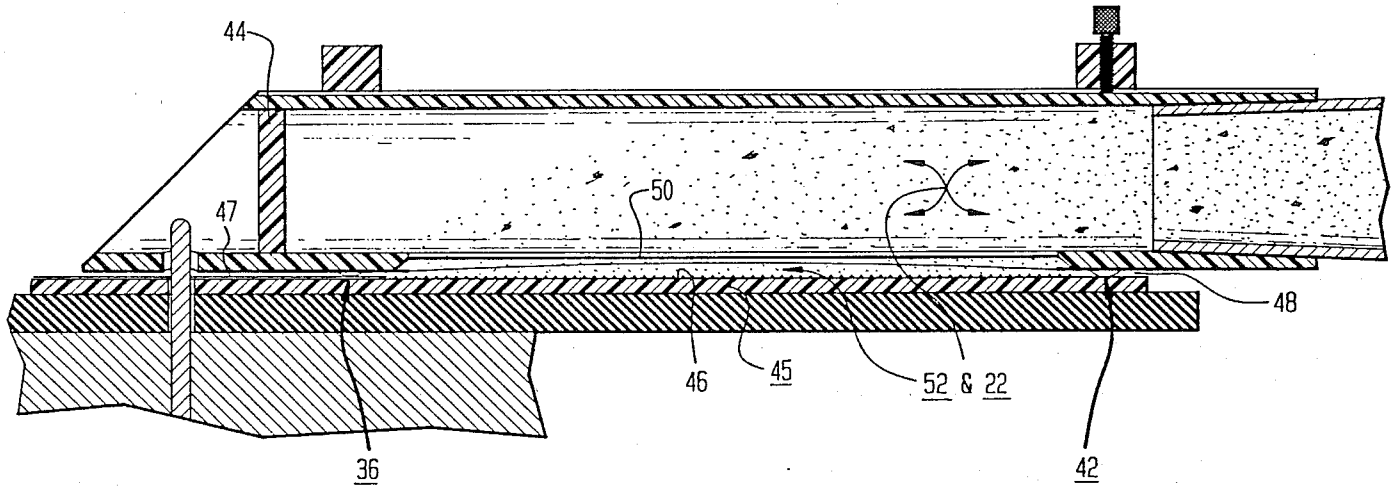
FIG. 5 is a detail cross-sectional elevational view of the preferred record vacuum cleaning attachment apparatus of the present invention of FIG. 4D, illustrating the dirt, dust, grease, grime and chemicals which are suspended in the cleaning fluid being removed from the upper playing surface of the phonograph record.

Fifth, as illustrated in FIG. 1, 5 and 6, a wet/dry shop vacuum cleaner 16 is attached to the record vacuum cleaning attachment apparatus 12 by inserting nozzle 60 of the shop vacuum cleaner 16 into tapered entrance 58 of record vacuum cleaning attachment apparatus 12.

Sixth, as illustrated in FIGS. 4D and 6, the record vacuum cleaning attachment apparatus 12 and the attached nozzle 60 are mounted onto the central spindle 20 of rotatable platter 18 and over the playing surface 46 of phonograph record 45 so that the longitudinal slot 50 covers a radius of the upper playing surface 46 of phonograph record 45.

Seventh, as illustrated in FIG. 5, the wet/dry shop vacuum cleaner 16 is actuated to create a partial vacuum in the interior 29 of the record vacuum cleaning attachment apparatus 12 causing suction to emanate from longitudinal slot 50.

Eighth, as illustrated in FIG. 4D and 5, the record 45 and rotatable platter 18 are rotated, preferably by hand, relative to the longitudinal slot 50 of the record vacuum cleaning attachment apparatus 12 so that the slot 50 passes over the entire upper playing surface 46 of the record 45 and safely removes the dirt, dust, grease, grime and chemicals suspended in the cleaning fluid on the upper playing surface 46 of the phonograph record 45 without damaging the playing surface 46 of the phonograph record 45. Usually, two full rotations of the record 45 is sufficient.

Ninth, the playing surface 46 of the phonograph record 45 is buffed with a lint-free, soft cloth or towel. The entire cleaning operation takes about 40 seconds.

While the invention has been described with references to the preferred embodiment thereof, it will be appreciated by those or ordinary skill in the art that various changes may be made to the structure, components and materials of the present invention without departing from its spirit and scope.

I claim:

1. A record vacuum cleaning attachment apparatus for safely removing dirt, dust, grease, grime, chemicals and cleaning fluid on the surface of a phonograph record without damaging the playing surface of the phonograph record comprising:

(a) a tube having a first end, a second end, a hollow interior, a top surface and a bottom surface;

(b) a spindle mounting aperture means on the bottom of the first end of the tube for rotatably mounting the tube to a central spindle of a rotatable platter for phonograph records;

(c) separation means for separating the tube from the playing surface of the phonograph record including (i) an interior separation means for separating the tube from the playing surface of the phonograph record which is attached to the bottom surface of the tube between the spindle mounting aperture means and the portion of the tube which covers the playing surface of the phonograph record and (ii) An exterior separation means for separating the tube from the playing surface of the phonograph record which is attached to the bottom surface of said tube between said interior separation means and said second end of said tube by a slidably locking holding means for slidably adjusting and locking the exterior separation means to permit the apparatus to be adjusted for cleaning phonograph records of different size playing surface;

(d) an attachment means for attaching the record vacuum cleaning attachment apparatus to a vacuum cleaner means;

(e) an opening in said bottom surface of said tube comprising a longitudinal slot which extends over the playing surface of the phonograph record when the phonograph record is placed onto the spindle of the rotatable platter and the vacuum cleaning attachment apparatus is mounted onto the rotatable platter by the spindle aperture mounting means; and, (f) a closure means for closing said first end of said tube between said spindle aperture mounting means and said opening.

2. The apparatus of claim 1 wherein the bottom of said tube is bevelled toward the interior of the tube in a smooth arc beginning at a first interior end of said slot closest to said spindle mounting attachment means and extending to a second exterior end of said slot closest to said second end of said tube in order to avoid contacting the playing surface of said phonograph record when the phonograph record is being cleaned.

3. The apparatus of claim 2 wherein said attachment means includes a tapered entrance on the interior of said second end of said tube for accommodating a standard size tapered nozzle of a vacuum cleaner means.

4. The apparatus of claim 3 wherein said radius of curvature of said arc is approximately 36 inches.

5. The apparatus of claim 4 wherein said tapered entrance of said tube has an interior dimension of approximately 1 and ¼ inches at its opening and an interior diameter of approximately 1 and 7/32 inches at about 1 inch from said second end in a direction towards said first end.

6. The apparatus of claim 5 wherein said slidably locking holding means includes spring loaded stop means for engaging the surface of said tube to allow the apparatus to be easily adjustable to accommodate a standard size phonograph record.

7. The apparatus of claim 6 wherein said slidably locking holding means includes a locking detent in the exterior surface of said tube to hold said slidably locking holding means at a position on said tube to accommodate a standard size phonograph record.

8. The apparatus of claim 5 wherein said slidably locking holding means includes thumbscrew means for engaging the exterior surface of said tube to accommodate a standard size phonograph record.

9. The apparatus of claim 8 wherein said slidably locking holding means includes a collar means surrounding said tube and said thumbscrew means extending through said collar means to engage a longitudinal slot for aligning the separation means on the outside surface of the tube, wherein said slot includes a locking detent positioned to hold the slidably locking holding means at a position on the tube to accommodate a standard size phonograph record.

10. The apparatus of claim 8 wherein said slidably locking holding means includes a collar means surrounding said tube, said spring loaded stop means extending through said collar means to engage a longitudinal slot for aligning the separation means on the outside surface of the tube, wherein said slot includes said locking detent on the outside surface of said tube.

11. The apparatus of claim 10 wherein said separation means include bearings made from a Teflon-like material.

12. The apparatus of claim 11 wherein said inner separation means includes two of said bearings attached to the bottom of said tube and said outer separation means includes two of said bearings attached to said slidably locking holding means so as to maintain a constant separation between the bottom of the tube and the playing surface of said phonograph record.

13. A kit for cleaning phonograph records comprising:

(a) cleaning fluid means for loosening, dissolving and suspending dirt, grease, grime, chemicals and dust on the playing surface of the record, and wherein said cleaning fluid means includes an aqueous solution of p-tertiary-octylphenoxyl polyethyl alcohol;

(b) brush means for spreading the fluid means on the surface of the record to loosen, dissolve and suspend the dirt, dust, grease and chemicals on the playing surface of the record; and, (c) said record vacuum, cleaning attachment apparatus recited in claim 12.

14. A method for cleaning phonograph records comprising the following steps:

(a) placing a phonograph record on a rotatable platter having a central spindle;

(b) applying cleaning fluid to the upper surface of the phonograph records, said cleaning fluid including an aqueous solution of p-tertiary-octylphenoxyl polyethyl alcohol;

(c) spreading the cleaning fluid over the playing surface of the phonograph record with a brush to loosen, dissolve and suspend in the cleaning fluid any dirt, dust, grease, grime and chemicals on the playing surface of the record;

(d) attaching a wet/dry shop vacuum cleaner to said record vacuum cleaning attachment apparatus recited in claim 12;

(e) mounting the record vacuum cleaning attachment apparatus onto the central spindle of the rotatable platter so that the longitudinal slot of the apparatus covers a radius of the phonograph record;

(f) actuating the wet/dry shop vacuum cleaner means to create a partial vacuum in the apparatus causing a suction to emanate from the longitudinal slot; and, (g) rotating the record relative to the longitudinal slot of the apparatus so that the slot passes over the entire upper playing surface of the record to safely remove the dirt, dust, grease, grime, and chemicals suspended in the cleaning fluid on the playing surface of the phonograph record without damaging the playing surface of the phonograph record.

15. A kit for cleaning phonograph records comprising:

(a) cleaning fluid means for loosening, dissolving and suspending dirt, grease, grime, chemicals and dust on the playing surface of the record;

(b) brush means for spreading the fluid means on the surface of the record to loosen, dissolve and suspend the dirt, dust, grease and chemicals on the playing surface of the record; and, (c) said record vacuum cleaning attachment apparatus recited in claim 3.

16. A method for cleaning phonograph records comprising the following steps:

(a) placing a phonograph record on a rotatable platter having a central spindle;

(b) applying cleaning fluid to the upper surface of the phonograph record;

(c) spreading the cleaning fluid over the playing surface of the phonograph record with a brush to loosen, dissolve and suspend in the cleaning fluid any dirt, grease, grime, chemicals and dust on the record's surface;

(d) attaching a vacuum cleaner means to said record vacuum cleaning attachment apparatus recited in claim 3;

(e) mounting the record vacuum cleaning attachment apparatus onto the central spindle of the rotatable platter so that the longitudinal slot of the apparatus covers a radius of the phonograph record;

(f) actuating vacuum cleaner means to create a partial vacuum in the apparatus causing a suction to emanate from the longitudinal slot; and, (g) rotating the record relative to the longitudinal slot of the apparatus so that the slot passes over the entire upper playing surface of the record to safely remove the dirt, dust, grease, grime, and chemicals suspended in the cleaning fluid on the playing surface of the phonograph record without damaging the playing surface of the phonograph record.

* * * * *